US010527266B2

(12) United States Patent
Spahnie et al.

(10) Patent No.: US 10,527,266 B2
(45) Date of Patent: Jan. 7, 2020

(54) LIGHTING SYSTEM

(71) Applicant: Current Lighting Solutions, LLC, East Cleveland, OH (US)

(72) Inventors: Brian Morgan Spahnie, East Cleveland, OH (US); Bill (Xin) Wang, Shanghai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/030,039

(22) Filed: Jul. 9, 2018

(65) Prior Publication Data

US 2019/0049098 A1 Feb. 14, 2019

(30) Foreign Application Priority Data

Aug. 14, 2017 (CN) ..... 2017 1 0691583

(51) Int. Cl.
*F21V 21/14* (2006.01)
*G09F 13/04* (2006.01)
(Continued)

(52) U.S. Cl.
CPC ..... *F21V 21/14* (2013.01); *G09F 13/04* (2013.01); *G09F 13/22* (2013.01);
(Continued)

(58) Field of Classification Search
CPC ..... F21V 21/14; F21V 21/30; F21V 19/02; G09F 13/04; G09F 13/22;
(Continued)

(56) References Cited

U.S. PATENT DOCUMENTS 5,404,282 A * 4/1995 Klinke ..... F21K 9/00 257/E25.028
5,559,681 A * 9/1996 Duarte ..... F21V 21/08 362/231

(Continued)

OTHER PUBLICATIONS

Extended European Search Report and Opinion issued in connection with corresponding EP Application No. 18187794.5 dated Jan. 25, 2019.

*Primary Examiner* — Joseph L Williams
*Assistant Examiner* — Jose M Diaz
(74) *Attorney, Agent, or Firm* — Buckley, Maschoff & Talwalkar, LLC

(57) ABSTRACT

The present disclosure is directed to a lighting system, the lighting system comprising at least two lighting modules. Each lighting modules includes a plurality of light emitting elements which are electrically coupled to one another. The lighting system further comprises a suspension assembly which is configured for longitudinally attaching to the at least two lighting modules to be arranged as two lighting modules adjacent to each other. The suspension assembly includes a first section configured for attaching to one of the two adjacent lighting modules, and a second section configured for attaching to the other one of the two adjacent lighting modules. The first section and the second section are mechanically connected for adjusting the longitudinal distance between the two adjacent lighting modules.

16 Claims, 6 Drawing Sheets

(51) Int. Cl.
*G09F 13/22* (2006.01)
*F21Y 115/10* (2016.01)
*F21Y 103/10* (2016.01)

(52) U.S. Cl.
CPC ..... *F21Y 2103/10* (2016.08); *F21Y 2115/10* (2016.08); *G09F 2013/222* (2013.01)

(58) Field of Classification Search
CPC ..... G09F 2013/222; F21Y 2103/10; F21Y 2103/00; F21Y 2115/10; F21Y 2115/20; F21K 9/00; F21K 9/20; F21K 9/27; F21S 4/00; F21S 4/20; F21S 4/28
See application file for complete search history.

(56) References Cited

U.S. PATENT DOCUMENTS 6,793,369 B2 * 9/2004 Calzaretta ..... E04F 11/163 362/219
7,887,218 B2 * 2/2011 Wang ..... F21V 21/0808 362/240
8,132,935 B2 * 3/2012 Park ..... F21K 9/00 362/235
8,449,145 B1 * 5/2013 Berry ..... F21S 4/00 362/249.02
8,721,114 B2 * 5/2014 Wassel ..... F21V 7/00 362/241
2006/0006405 A1 * 1/2006 Mazzochette ..... H01L 25/0753 257/99
2006/0215398 A1 * 9/2006 Farmer ..... G09F 9/33 362/227
2007/0153508 A1 * 7/2007 Nall ..... F21V 21/002 362/219
2008/0087903 A1 * 4/2008 Stoyan ..... F21S 2/005 257/88
2008/0244944 A1 10/2008 Nall et al.
2009/0073693 A1 3/2009 Nall et al.
2010/0238663 A1 9/2010 Chen et al.
2012/0155085 A1 * 6/2012 Chang ..... F21V 23/06 362/249.02
2012/0243227 A1 * 9/2012 Shimizu ..... F21S 8/04 362/249.01
2014/0268786 A1 9/2014 Quaal et al.
2015/0167910 A1 * 6/2015 Stoyan ..... F21S 2/005 29/25.01
2017/0072836 A1 * 3/2017 Fay ..... B60Q 1/0088
2017/0370532 A1 * 12/2017 Ma ..... F21V 31/00

* cited by examiner

LIGHTING SYSTEM

BACKGROUND

Embodiments of the present disclosure relate to lighting system and, more particularly, to suspension assembly of the lighting system.

Installers are always looking for a quicker and reliable means to install LED lighting modules into a box sign. Typically, bars and rails have been used to support the LED lighting modules. In the recent past prepopulated strings of LED lighting modules have been hung in the box sign from top and bottom supports to hold the string of LED lighting modules. In this way, many different strings need to be made depending on the depth of the sign. Moreover, clamp or tie used to hold the string of modules causes uneven and non-repeatable spacing among LED lighting modules, and the clamps come undone or the ties become loose as well.

Accordingly, it would be desirable to provide a better configuration to support the LED lighting modules at multiple depths and to be easily set for the spacing as needed among LED lighting modules, mounted from top to bottom.

BRIEF DESCRIPTION

In accordance with one embodiment disclosed herein, a lighting system is provided. The lighting system comprises at least two lighting modules, each lighting modules having a plurality of light emitting elements which are electrically coupled to one another; and a suspension assembly, configured for longitudinally attaching to the at least two lighting modules to be arranged as two lighting modules adjacent to each other. The suspension assembly includes a first section configured for attaching to one of the two adjacent lighting modules; and a second section configured for attaching to the other one of the two adjacent lighting modules; wherein the first section and the second section are mechanically connected for adjusting the longitudinal distance between the two adjacent lighting modules.

In accordance with another embodiment disclosed herein, a lighting system is provided. The lighting system comprises at least two lighting modules, each lighting modules having a plurality of light emitting elements which are electrically coupled to one another; and a suspension assembly, configured for longitudinally attaching to the at least two lighting modules to be arranged as two lighting modules adjacent to each other. The suspension assembly comprising: a first section configured for attaching to both of the two adjacent lighting modules; and a second section configured for fastening with both of the two adjacent lighting modules; wherein the first section and the second section are mechanically connected for adjusting the longitudinal distance between the two adjacent lighting modules.

DRAWINGS

These and other features and aspects of the present disclosure will become better understood when the following detailed description is read with reference to the accompanying drawings in which like characters represent like parts throughout the drawings, wherein.

DETAILED DESCRIPTION

Unless defined otherwise, technical and scientific terms used herein have the same meaning as is commonly understood by one of ordinary skill in the art to which this disclosure belongs. The terms "a" and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect.

Generally, embodiments of the disclosure provide a lighting system. It may be a separate component in various application, including cabinet signs, doubled-sided box signs, and other like applications built for use with lighting fixtures. The suspension assembly involved in the lighting system is simply to adjust for multiple depths after installation, easy connection for uniformity spacing among lighting modules, and simple maintenance.

Figure 1:
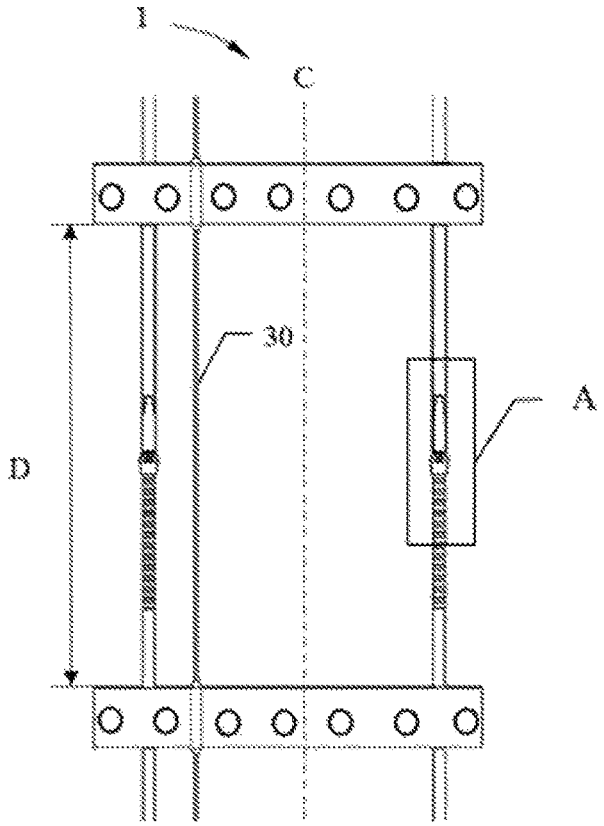
FIG. 1 and FIG. 2 are perspective views illustration of a lighting system with a suspension assembly in different operation states according to one embodiment.
Figure 2:
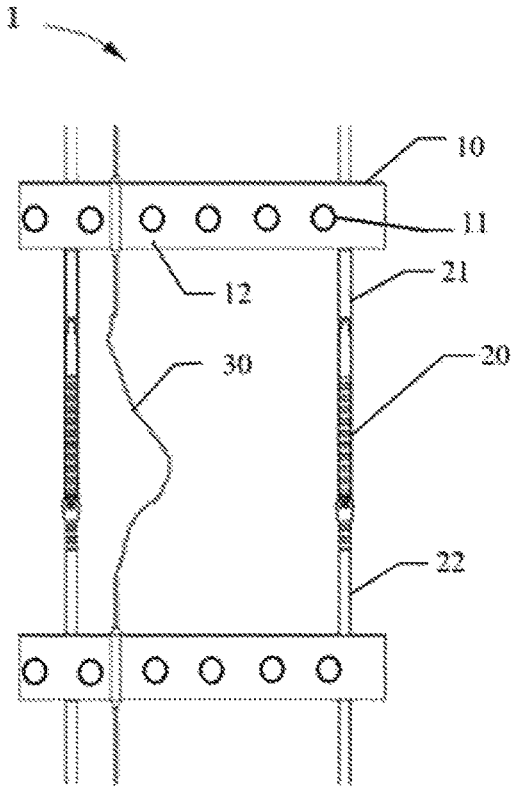

Now, referring to the drawings wherein identical reference numerals denote the same elements throughout the various views, FIGS. 1 and 2 depict an exemplary embodiment of a lighting system 1 with a suspension assembly 20 in different operation states. The lighting system 1 further includes at least two lighting modules 10, the suspension assembly 20 is longitudinally attached to each two adjacent lighting modules 10 from top to bottom. According to the exemplary lighting system illustrated herein, the suspension assembly 20 connects with two adjacent lighting modules 10 at both lateral ends of the adjacent lighting modules 10, so as to keep the lighting modules 10 as connected be relatively stable, and to easily balance a longitudinal distance D between the two adjacent lighting modules 10, i.e., evenly spaced from one another in a direction parallel to a longitudinal axis C.

The suspension assembly 20 in the exemplary lighting system illustrated herein is fixed, such as by gluing or welding, to each two adjacent lighting modules 10. The suspension assembly 20 may be integrally formed with the lighting modules 10.

Each lighting modules 10 generally includes a plurality of light emitting elements 11, such as light emitting diodes (LEDs), which are electrically coupled to one another and are mounted on a printed circuit board (PCB) 12. The lighting system 1 also includes at least one flexible electrical conductor 30 which is electrically and mechanically connected to the lighting modules 10 for supplying power to the LEDs mounted on the PCBs 12. When the suspension assembly 20 adjust the longitudinal distance D between two adjacent lighting modules 10, the flexible electrical conductor 30 may be pulled (shown in FIG. 1) or loosen (shown in FIG. 2).

Figure 3:
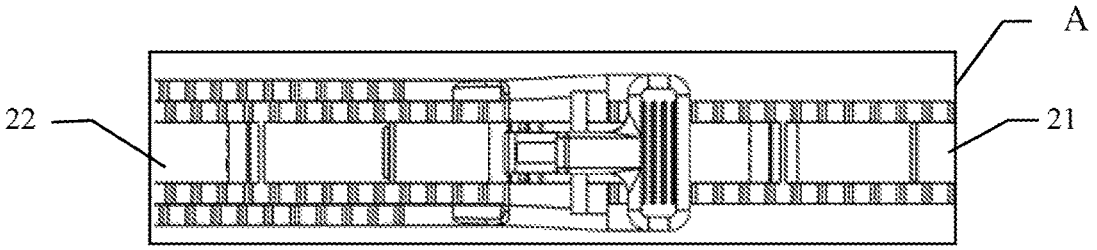
FIG. 3 is an enlarged view of portion A illustrated in FIG. 1.

Referring to FIG. 3, the suspension assembly 20 in this exemplary embodiment as illustrated includes a first section 21 and a second section 22, which are mechanically connected. The first section 21 is attached to one of the two adjacent lighting modules 10 and the corresponding second section 22 is attached to the other one.

Figure 4:
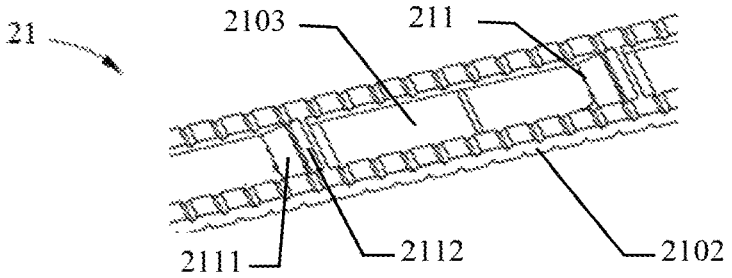
FIG. 4 is a perspective view illustration of a first section of the suspension assembly illustrated in FIG. 1.

Referring to FIG. 4, the first section 21 in this exemplary embodiment as illustrated includes a plurality of backstop elements 211 along the length of the first section 21. Each backstop element 211, projecting from an outer surface 2103 of the first section 21, includes a sliding surface 2111 with a smaller slope relative to the outer surface 2103 and a backstop surface 2112 with a larger slope, even perpendicular to the outer surface 2103 of the first section 21.

Figure 5:
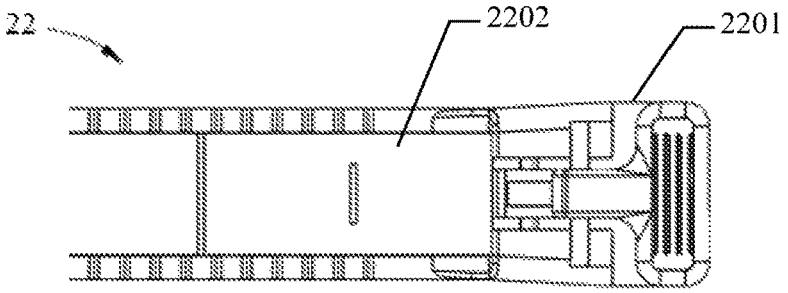
FIG. 5 is a front view illustration of a second section of the suspension assembly illustrated in FIG. 1.
Figure 6:
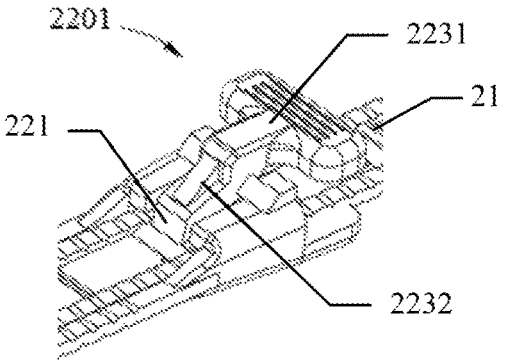
FIG. 6 and FIG. 7 are perspective views illustration of a positioning portion of the second section illustrated in FIG. 5.

Referring to FIG. 5, the second section 22 in this exemplary embodiment as illustrated includes a positioning portion 2201 configured for corresponding to the backstop elements 211 so as to put the first section 21 at a desirable position. The second section 22 further includes a sliding portion 2202 configured for the first section 21 to slide thereon along the length of the second section 22.

Referring to FIGS. 4, 5, 6 and 7, the positioning portion 2201 includes a positioning channel 222 configured for the first section 21 to get in and out thereof, an abutment element 221 configured for corresponding to the backstop elements 211, an elastic control element 223 for controlling the abutment element 221. The elastic control element 223 includes a control button 2231 for being pressed, and a driving arm 2232 connecting with the abutment element 221 and the control button 2231. When the control button 2233 is pressed, the abutment element 221 will be in response to the control button 2231 through the driving arm 2232.

Specifically, the first section 21 gets through the positioning channel 222 and moves ahead by sliding onto the sliding portion 2202. During sliding, the abutment element 221 contacts with the backstop element 211, i.e., the abutment element 221 slides across the sliding surface 2111, then slides back to abut the backstop surface 2112 if needed, so as to fix the first section 21 at a desirable position. When it needs to adjust the relative position between the first section 21' and the second section 22', the control button 2231 of the elastic control element 223 is pressed so that abutment element 221 is driven to not abut the backstop element 211, i.e., is controlled to release from the backstop elements 211 which fixes the first section 21 in previous position. It is understood that the abutment element 221 is controlled to be ready to correspond to the backstop elements 211 when the first section 21 gets in the positioning channel 222 and the elastic control element 223 is not pressed; and the abutment element 221 is controlled to release from the backstop elements 211 when the elastic control element 223 is pressed.

Figure 7:
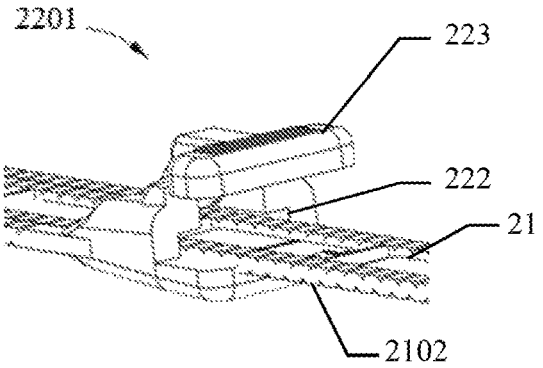

Referring to FIGS. 4, 5 and 7, The first section 21 further includes a plurality of flanges 2102 which position at edges of the first section 21 and extend against the outer surface 2103 of the first section 21. During sliding, the flanges 2102 contacts with the sliding portion 2202 of the second section 22 and provides frictional force so as to prevent from skidding.

Figure 8:
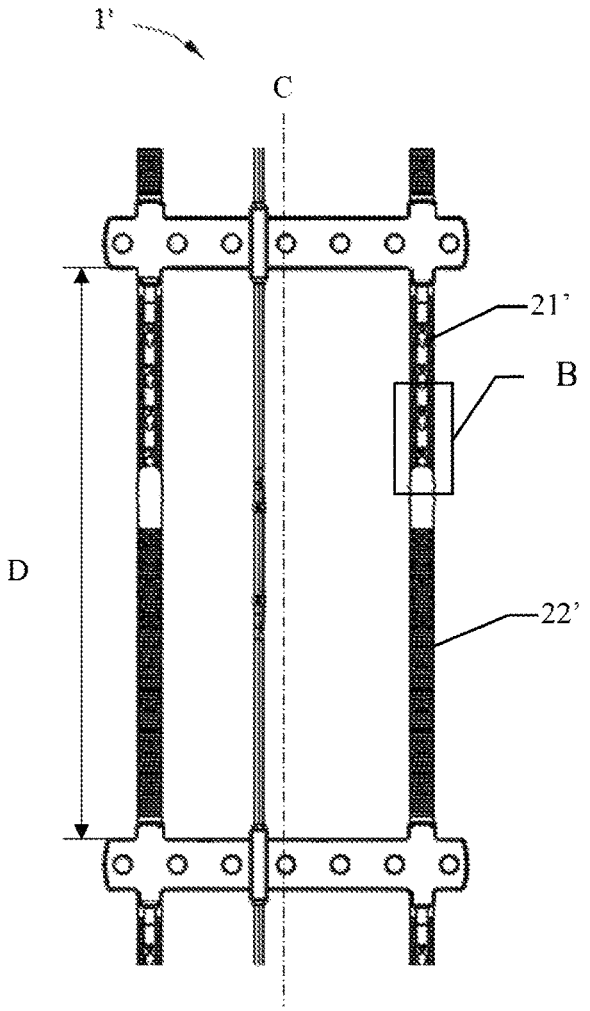
FIG. 8 and FIG. 9 are perspective views illustration of a lighting system with a suspension assembly in different operation states according to another embodiment.
Figure 9:
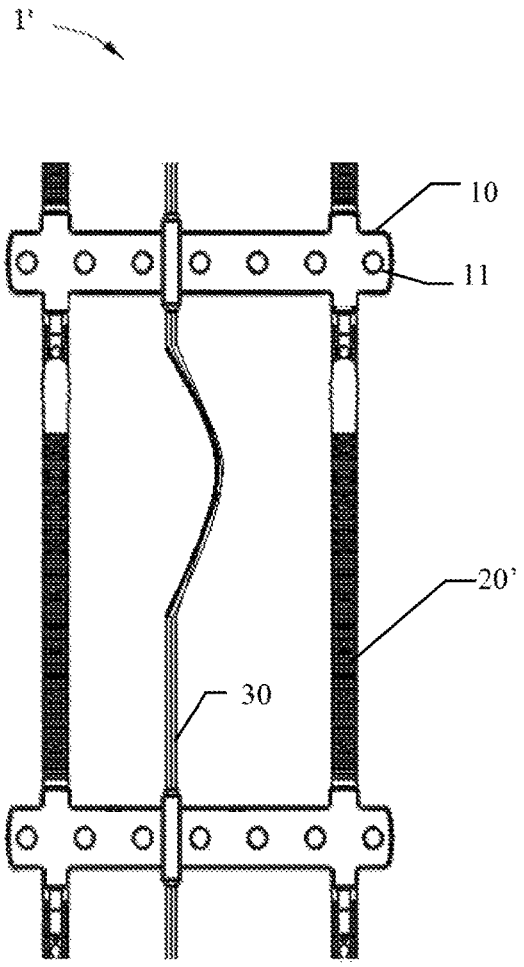

FIGS. 8 and 9 illustrate another example of a lighting system 1' with a suspension assembly 20' in different operation states. The lighting system 1' also includes at least two lighting modules 10, the suspension assembly 20' is longitudinally attached to each two adjacent lighting modules 10 from top to bottom, and is configured to keep the lighting modules 10 as connected be relatively stable as well as to easily balance a longitudinal distance D between the two adjacent lighting modules 10, i.e., evenly spaced from one another in a direction parallel to a longitudinal axis C. The lighting system 1' also includes at least one flexible electrical conductor 30 which is electrically and mechanically connected to the lighting modules 10 for supplying power to the LEDs 11 mounted on the PCBs. When the suspension assembly 20' adjust the longitudinal distance D between two adjacent lighting modules 10, the flexible electrical conductor 30 may be pulled (shown in FIG. 8) or loosen (shown in FIG. 9).

Figure 10:
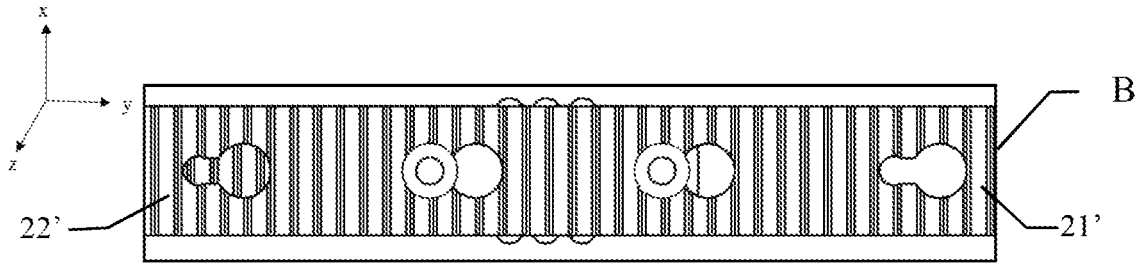
FIG. 10 is an enlarged view of portion B illustrated in FIG. 8.

Referring to FIG. 10, the suspension assembly 20' in this exemplary embodiment as illustrated includes a first section 21' and a second section 22', which are mechanically connected. The first section 21' is attached to one of the two adjacent lighting modules 10 and the corresponding second first section 22' is attached to the other one.

Figure 11:
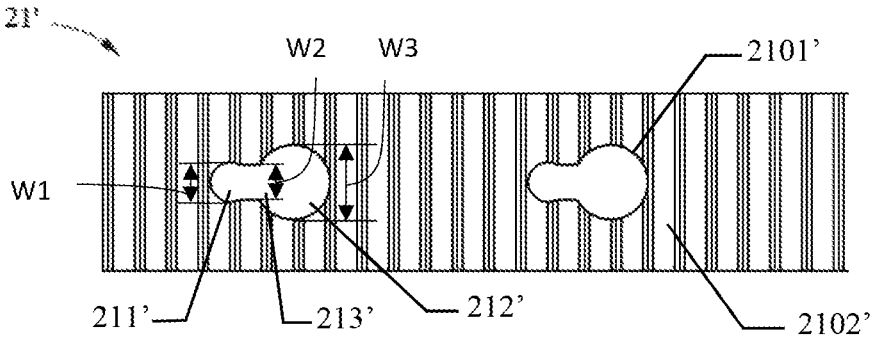
FIG. 11 is a front view illustration of a first section of the suspension assembly illustrated in FIG. 8.

Referring to FIG. 11, the first section 21' in this exemplary embodiment as illustrated includes a plurality of positioning portions 2101' along the length of the first section 21'. Each positioning portions 2101', integrally formed by one through-hole on an outer surface 2102' of the first section 21', includes a backstop element 211' with a first inner width w1, an elastic transition region 213' with a second inner width w2 and a positioning element 212' with a third inner width w3. Preferably, the first inner width w1 is smaller than the third inner width w3 and the first inner width w1 is not smaller than the second inner width w2. As illustrated in FIG. 11, the second inner width w2 is smaller than the first inner width w1.

Figure 12:
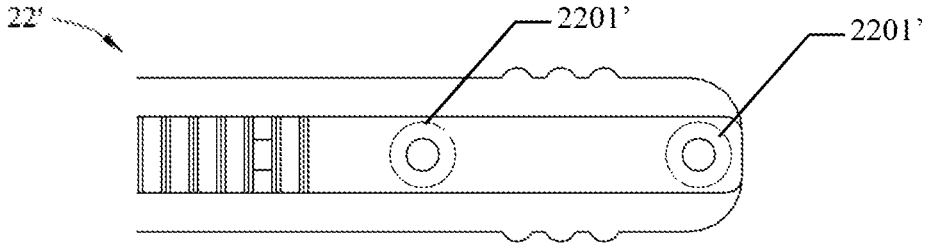
FIG. 12 is a front view illustration of a second section of the suspension assembly illustrated in FIG. 8.
Figure 13:
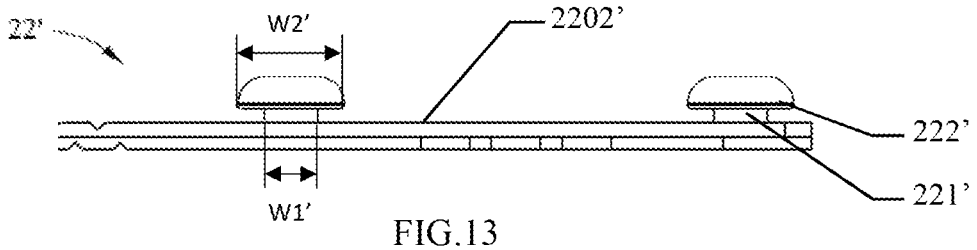
FIG. 13 is a side view illustration of a second section of the suspension assembly illustrated in FIG. 8.

Referring to FIGS. 12 and 13, the second section 22' in this exemplary embodiment as illustrated includes a plurality of protrusion portions 2201' along the length of the second section 22'. Each protrusion portions 2201', integrally projecting from an outer surface 2202' of the second section 22', includes a first abutment element 221' with a first outer width w1' and a second abutment element 222'. with a second outer width w2'. Preferably, the first outer width w1' is smaller than the second outer width w2'. Furthermore, the first outer width w1' is not smaller than the second inner width w2, the first outer width w1' is smaller than the first inner width w1, the third inner width w3 is smaller than the second outer width w2'.

Referring to FIGS. 10, 11, 12 and 13, the positioning element 212' is configured for the protrusion portions 2201' to get in and out thereof, the backstop element 211' is configured for corresponding to both of the first abutment element 221' and the second abutment element 222'. Specifically, when the protrusion portions 2201' get in the positioning element 212', i.e., the second abutment element 222' gets through the positioning element 212' where the first abutment element 221' follows, the first abutment element 221' will get through the elastic transition region 213' to the backstop element 211' under the force of pulling from top to bottom along the y direction. Meanwhile, the second abutment element 222' and the outer surface 2202' of the second section 22' defines the displacement that the first abutment element 221' may take place along the z direction so that the protrusion portions 2201' may be fixed in the backstop element 211', then both of the first section 21' and the second section 22' can be defined in a desirable position. When it needs to adjust the relative position between the first section 21' and the second section 22', the first abutment element 221' will get through the elastic transition region 213' to the positioning element 212' under the force of pulling from bottom to top along the y direction, then get out from the positioning portion 2101'. Accordingly, the protrusion portions 2201' of the second section 22' that was fixed in specific positioning portions 2101' of the first section 21' can be released from the previous position and can be repositioned by selecting other desirable positioning portions 2101' of the first section 21'.

Figure 14:
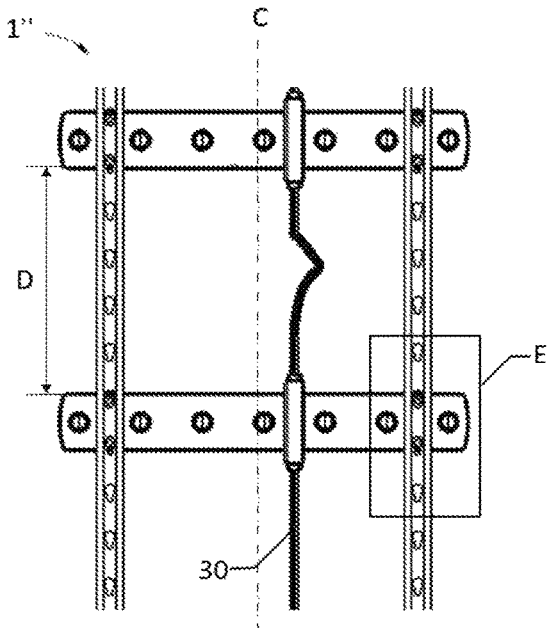
FIG. 14 and FIG. 15 are perspective views illustration of a lighting system with a suspension assembly in different operation states according to another embodiment.
Figure 15:
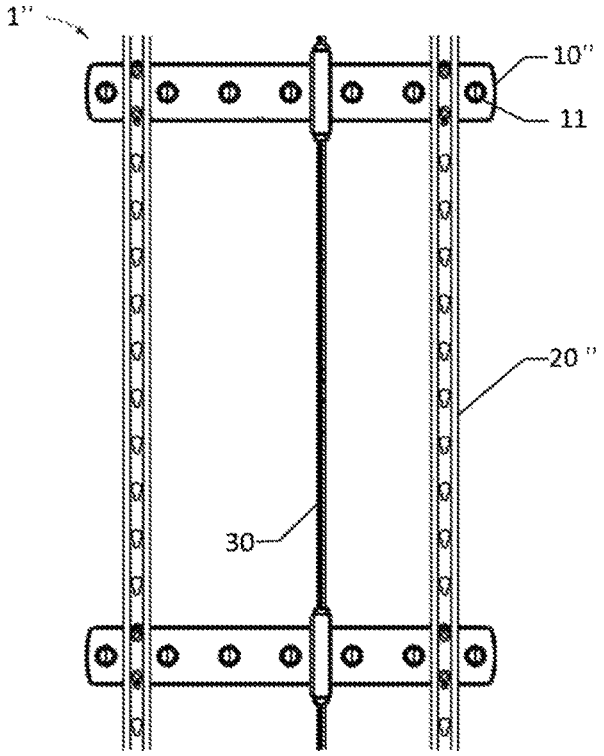

FIGS. 14 and 15 illustrate another example of a lighting system 1" with a suspension assembly 20" in different operation states. The lighting system 1" also includes at least two lighting modules 10", the suspension assembly 20" is longitudinally attached to each two adjacent lighting modules 10" from top to bottom, and is configured to keep the lighting modules 10" as connected be relatively stable as well as to easily balance a longitudinal distance D between the two adjacent lighting modules 10", i.e., evenly spaced from one another in a direction parallel to a longitudinal axis C. The lighting system 1" also includes at least one flexible electrical conductor 30 which is electrically and mechanically connected to the lighting modules 10" for supplying power to the LEDs 11 mounted on the lighting modules 10". When the suspension assembly 20" adjust the longitudinal distance D between two adjacent lighting modules 10", the flexible electrical conductor 30 may be pulled (shown in FIG. 14) or loosen (shown in FIG. 15).

Figure 16:
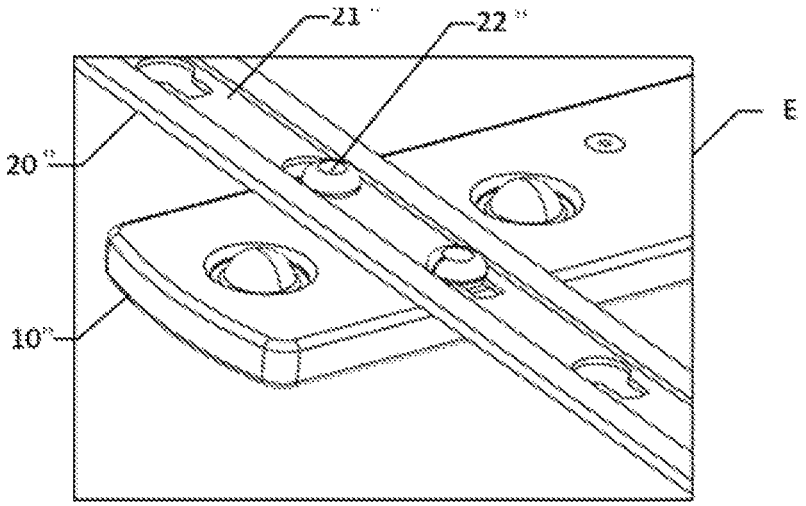
FIG. 16 is an enlarged view of portion E illustrated in FIG. 14.

Referring to FIG. 16, the suspension assembly 20" in this exemplary embodiment as illustrated includes a first section 21" and a second section 22", which are mechanically connected. The first section 21" is attached to both of the two adjacent lighting modules 10" and the corresponding second first section 22" is fastened with both of the two adjacent lighting modules 10".

Figure 17:
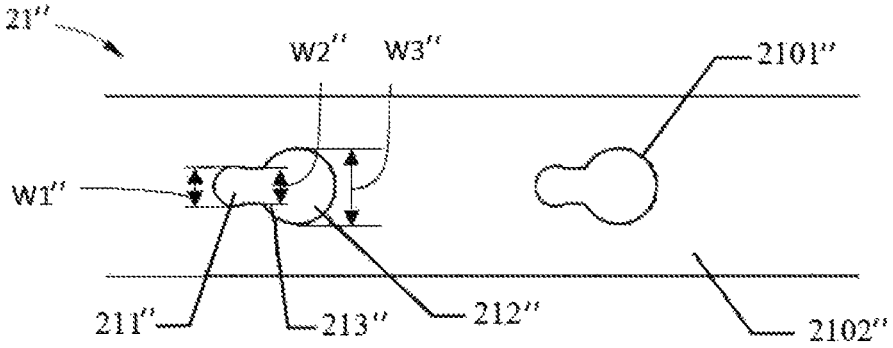
FIG. 17 is a perspective view illustration of a first section of the suspension assembly illustrated in FIG. 14.

Referring to FIG. 17, the first section 21" in this exemplary embodiment as illustrated includes a plurality of positioning portions 2101" along the length of the first section 21". Each positioning portions 2101", integrally formed by one through-hole on an outer surface 2102" of the first section 21", includes a backstop element 211" with a first inner width w1", an elastic transition region 213" with a second inner width w2" and a positioning element 212" with a third inner width w3". Preferably, the first inner width w1" is smaller than the third inner width w3" and the first inner width w1" is not smaller than the second inner width w2". As illustrated in FIG. 17, the second inner width w2" is smaller than the first inner width w1".

Figure 18:
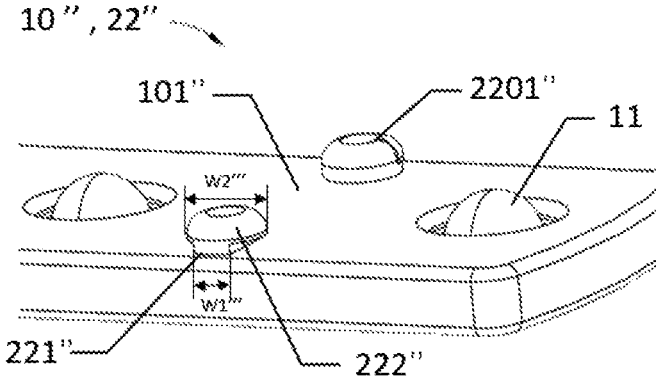
FIG. 18 is a perspective view illustration of the lighting module and a second section of the suspension assembly illustrated in FIG. 14.

Referring to FIG. 18, the second section 22" in this exemplary embodiment as illustrated includes a plurality of protrusion portions 2201" along the width of the lighting modules 10". Each protrusion portions 2201", integrally projecting from an outer surface 101" of the lighting modules 10", includes a first abutment element 221" with a first outer width w1'" and a second abutment element 222" with a second outer width w2'". Preferably, the first outer width w1'" is smaller than the second outer width w2'". Furthermore, the first outer width w1'" is not smaller than the second inner width w2", the first outer width w1'" is smaller than the first inner width w1", the third inner width w3" is smaller than the second outer width w2'".

Referring to FIGS. 16, 17 and 18, the positioning element 212" is configured for the protrusion portions 2201" to get in and out thereof, the backstop element 211" is configured for corresponding to both of the first abutment element 221" and the second abutment element 222', the specific operation manner of these elements is as same as the embodiment shown in FIGS. 10 to 13 as described above.

While the invention has been described with reference to exemplary embodiments, it will be understood by those skilled in the art that various changes may be made and equivalents may be substituted for elements thereof without departing from the scope of the invention. Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional assemblies and techniques in accordance with principles of this disclosure. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lighting system (1, 1'), comprising:

at least two lighting modules (10), each lighting modules having a plurality of light emitting elements (11) which are electrically coupled to one another; and a suspension assembly (20), configured for longitudinally attaching to the at least two lighting modules (10) to be arranged as two lighting modules adjacent to each other, the suspension assembly (20) comprising:

a first section (21, 21') configured for attaching to one of the two adjacent lighting modules;

the first section (21) including a plurality of backstop elements (211) along the length of the first section (21); and a second section (22, 22') configured for attaching to the other one of the two adjacent lighting modules;

wherein the first section (21, 21') and the second section (22, 22') are mechanically connected for adjusting a longitudinal distance (D) between the two adjacent lighting modules.

2. The lighting system (1') of claim 1, wherein the first section (21') comprises a plurality of positioning portions (2101') along the length of the first section (21'), each positioning portions (2101') comprising backstop element (211') and positioning element (212'); the second section (22') comprises a plurality of protrusion portions (2201') along the length of the second section (22'), each protrusion portions (2201') comprising a first abutment element (221') and a second abutment element (222'); wherein the positioning element (212') is configured for the protrusion portions (2201') to get in and out thereof, the backstop element (211') is configured for corresponding to both of the first abutment element (221') and the second abutment element (222').

3. The lighting system (1') of claim 2, wherein each positioning portions (2101') is integrally formed by one through-hole comprising the backstop element (211') with a first inner width (w1), an elastic transition region (213') with a second inner width (w2), and the positioning element (212') with a third inner width (w3); wherein the first inner width (w1) is smaller than the third inner width (w3) and the first inner width (w1) is not smaller than the second inner width (w2).

4. The lighting system (1') of claim 3, wherein each protrusion portions (2201') is integrally formed at least by the first abutment element (221') with a first outer width (w1') and the second abutment element (222') with a second outer width (w2'); wherein the first outer width (w1') is smaller than the second outer width (w2'), the first outer width (w1') is not smaller than the second inner width (w2), the first outer width (w1') is smaller than the first inner width (w1) and the third inner width (w3) is smaller than the second outer width (w2').

5. The lighting system (1') of claim 2, wherein the backstop element (211') is controlled to correspond to the first abutment element (221') and the second abutment element (222') when the protrusion portion (2201') gets in the positioning portion (2101') and the first abutment element (221') is contained in the backstop element (211').

6. The lighting system (1') of claim 5, wherein the backstop element (211') is controlled to release the first abutment element (221') and the second abutment element (222') when the protrusion portion (2201') gets out from the positioning portion (2101').

7. The lighting system (1) of claim 1, the second section (22) including a positioning portion (2201) having an abutment element (221) configured for corresponding to the backstop elements (211), and a positioning channel (222) configured for the first section (21) to get in and out thereof.

8. The lighting system (1) of claim 7, wherein the positioning portion (2201) further comprises an elastic control element (223) for controlling the abutment element (221); wherein the abutment element (221) is controlled to be ready to correspond to the backstop elements (211) when the first section (21) gets in the positioning channel (222) and the elastic control element (223) is not pressed; and the abutment element (221) is controlled to release from the backstop elements (211) when the elastic control element (223) is pressed.

9. The lighting system (1) of claim 7, wherein the second section (22) further comprises a sliding portion (2202) configured for the first section (21) to slide thereon along the length of the second section (22).

10. The lighting system (1) of claim 9, wherein the first section (21) further comprises a plurality of flanges (2102) configured for contacting with the sliding portion (2202).

11. A lighting system (1, 1') comprising:

at least two lighting modules (10), each lighting modules having a plurality of light emitting elements (11) which are electrically coupled to one another; and a suspension assembly (20), configured for longitudinally attaching to the at least two lighting modules (10) to be arranged as two lighting modules adjacent to each other, the suspension assembly (20) comprising:

a first section (21, 21') configured for attaching to one of the two adjacent lighting modules; and a second section (22, 22') configured for attaching to the other one of the two adjacent lighting modules;

wherein the first section (21, 21') and the second section (22, 22') are mechanically connected for adjusting the longitudinal distance (D) between the two adjacent lighting modules; and wherein the first section (21) comprises a plurality of backstop elements (211) along the length of the first section (21); and the second section (22) comprises a positioning portion (2201) having an abutment element (221) configured for corresponding to the backstop elements (211), and a positioning channel (222) configured for the first section (21) to get in and out thereof.

12. A lighting system (1"), comprising:

at least two lighting modules (10"), each lighting modules having a plurality of light emitting elements (11) which are electrically coupled to one another; and a suspension assembly (20"), configured for longitudinally attaching to the at least two lighting modules (10") to be arranged as two lighting modules adjacent to each other, the suspension assembly (20") comprising:

a first section (21") configured for attaching to both of the two adjacent lighting modules;

the first section (21") including a plurality of positioning portions (2101") along the length of the first section (21"); and a second section (22") configured for fastening with both of the two adjacent lighting modules;

wherein the first section (21") and the second section (22") are mechanically connected for adjusting a longitudinal distance (D) between the two adjacent lighting modules.

13. The lighting system (1") of claim 12, each positioning portions (2101") comprising backstop element (211") and positioning element (212"); the second section (22") comprises a plurality of protrusion portions (2201") along the width of the lighting module (10"), each protrusion portions (2201") comprising a first abutment element (221") and a second abutment element (222"); wherein the positioning element (212") is configured for the protrusion portions (2201") to get in and out thereof, the backstop element (211") is configured for corresponding to both of the first abutment element (221") and the second abutment element (222").

14. The lighting system (1") of claim 13, wherein each positioning portions (2101") is integrally formed by one through-hole comprising the backstop element (211") with a first inner width (w1"), an elastic transition region (213") with a second inner width (w2"), and the positioning element (212") with a third inner width (w3"); wherein the first inner width (w1") is smaller than the third inner width (w3") and the first inner width (w1") is not smaller than the second inner width (w2").

15. The lighting system (1") of claim 14, wherein each protrusion portions (2201") is integrally formed at least by the first abutment element (221") with a first outer width (w1'") and the second abutment element (222") with a second outer width (w2'"); wherein the first outer width (w1'") is smaller than the second outer width (w2'"), the first outer width (w1'") is not smaller than the second inner width (w2"), the first outer width (w1'") is smaller than the first inner width (w1") and the third inner width (w3") is smaller than the second outer width (w2'").

16. The lighting system (1") of claim 13, wherein the backstop element (211") is controlled to correspond to the first abutment element (221") and the second abutment element (222") when the protrusion portion (2201") gets in the positioning portion (2101") and the first abutment element (221") is contained in the backstop element (211"); and the backstop element (211") is controlled to release the first abutment element (221") and the second abutment element (222") when the protrusion portion (2201") gets out from the positioning portion (2101").

* * * * *